US007997819B1

(12) United States Patent
Kunert et al.

(10) Patent No.: US 7,997,819 B1
(45) Date of Patent: Aug. 16, 2011

(54) SYSTEM AND APPARATUS FOR MOBILE INFORMATION HANDLING

(75) Inventors: Steven R. Kunert, Cedar Rapids, IA (US); Blayne E. Medema, Cedar Rapids, IA (US); Matthew Miller, Cedar Rapids, IA (US)

(73) Assignee: Mobile Oasis LLC DBA Mobile Demand LLC, Hiawatha, IA (US)

( * ) Notice: Subject to any disclaimer, the term of this patent is extended or adjusted under 35 U.S.C. 154(b) by 563 days.

(21) Appl. No.: 11/401,111

(22) Filed: Apr. 10, 2006

Related U.S. Application Data

(60) Provisional application No. 60/669,619, filed on Apr. 8, 2005.

(51) Int. Cl.
*B41J 3/39* (2006.01)
*B41J 29/02* (2006.01)
*B41J 29/12* (2006.01)

(52) U.S. Cl. ..... 400/691; 400/693; 248/917

(58) Field of Classification Search ..... 400/613, 400/691, 692, 693; 347/108; 248/917; 235/7 R
See application file for complete search history.

(56) References Cited

U.S. PATENT DOCUMENTS

| | | | | |
|---|---|---|---|---|
| 4,707,156 | A * | 11/1987 | Clark | 400/613.2 |
| 5,316,107 | A * | 5/1994 | Wieschemann et al. | 186/61 |
| 5,931,098 | A * | 8/1999 | Bates | 101/484 |
| 6,428,227 | B2 * | 8/2002 | Petteruti et al. | 400/691 |
| 6,980,419 | B2 * | 12/2005 | Smith et al. | 361/681 |
| 7,131,778 | B2 * | 11/2006 | Tobin et al. | 400/120.17 |
| 2003/0222149 | A1 * | 12/2003 | Solomon et al. | 235/472.01 |
| 2004/0233623 | A1 * | 11/2004 | Hillman et al. | 361/683 |
| 2005/0035198 | A1 * | 2/2005 | Wilensky | 235/383 |

* cited by examiner

*Primary Examiner* — Leslie J Evanisko
*Assistant Examiner* — Marissa L Ferguson-Samreth
(74) *Attorney, Agent, or Firm* — Suiter Swantz pc llo

(57) ABSTRACT

A mounting apparatus for mounting a mobile information handling device comprising a frame assembly, a mount for mounting a mobile information handling device and a support for supporting a printing device. Frame assembly may include a base plate having a first surface configured to receive a printable media supply housing. Printable media supply housing may be a basket assembly. Support may be pivotally coupled to the frame assembly, allowing insertion and removal of printable media supply housing. Mounting apparatus may be further comprised of a mounting arm having at least one universal joint coupling the mount to the frame assembly. Mounting arm may allow three-dimensional rotational adjustment of the mount.

9 Claims, 12 Drawing Sheets

SYSTEM AND APPARATUS FOR MOBILE INFORMATION HANDLING

CROSS REFERENCE TO RELATED APPLICATONS

The present application claims the benefit under 35 U.S.C. §119 of U.S. Provisional Application Ser. No. 60/669,619 filed Apr. 8, 2005. Said U.S. Provisional Application Ser. No. 60/669,619 filed Apr. 8, 2005 is hereby incorporated by reference in its entirety.

FIELD OF THE INVENTION

The present invention relates generally to the field of mounting systems and more particularly to a mobile information handling system and apparatus.

BACKGROUND

Delivery and inventory verification is an important aspect of intrastate, interstate and international commerce. For instance, industries such as warehousing, manufacturing, healthcare, and hospitality rely heavily upon prompt and accurate transport and delivery of goods. As such, providing efficient delivery of goods and maintaining accurate records of shipments and inventory are crucial elements in the delivery process. Delivery and inventory verification systems are typically paper-based, often requiring manual processing of deliveries and on-site verification of available inventory. Sales personnel must usually return to a warehouse, loading station, or central office and complete the required delivery paperwork for processing. Following completion of the paperwork, a truck-build for a subsequent delivery must usually be constructed by next-shift employees, creating a significant time lapse between order acquisition and delivery of desired goods. Disadvantageously, delivery personnel may not be operating at maximum efficiency, due the numerous constraints of such a paper based system. Further, this operating inefficiency may prevent delivering parties from complying with supplier directives and mandates, resulting in customer dissatisfaction, and potential lost sales and revenue.

As technological advances are made in mobile communications technologies, it is often desirable for delivery personnel to transport communication and computing devices to and from delivery sites. These devices may aid in streamlining the delivery process by reducing access time to pertinent delivery information and reducing the amount of paperwork delivery personnel must transport. However, these portable communications and computing devices, that may be relatively expensive, may be subject to significant wear and tear due to their daily usage by delivery personnel. Additionally, a certain amount of paperwork is generally necessary for deliveries, whether required by a shipper, a delivery receiver, or other such mandate. Such paperwork is typically generated prior to dispatching a delivery. Disadvantageously, any changes needing to be made to delivery paperwork must be done manually, and may result in illegible modifications and inaccurate paperwork.

Consequently, it would be advantageous if a system and apparatus existed that provided mobile computing based sales force automation, providing efficient delivery of products and associated services to customers who have stringent requirements for their mobile computing systems.

SUMMARY OF THE INVENTION

Accordingly, the present invention is directed to a novel system and apparatus for mobile information handling. In a first aspect of the invention, apparatus may be a mounting apparatus comprised of a frame assembly, a mount for mounting a portable information handling device, and a support for supporting a printing device. Portable information handling device may be a computing device having computing peripherals and accessories. Mounting apparatus may be suitable for docking and stabilizing mobile computing components such as a portable information handling device, a printing device, a portable communications device, and like computing and communication devices. Frame assembly may include one or more slots suitable for sliding a vehicle safety strap such as a seatbelt through the one or more slots for securing and stabilizing the frame assembly during transportation. Mounting apparatus may also include a stabilizing rod for further support and stabilization. Frame assembly may further include a basket assembly for holding a printable media supply. Support may be pivotally coupled to the frame assembly, allowing outward rotation of the printing device. Outward rotation of the support may provide access to basket assembly for insertion or removal of printable media supply. Mount may further comprise a mounting plate for supporting an information handling device and a mounting arm coupling the mounting plate to the frame assembly. Advantageously, the mounting arm may allow three dimensional rotational positioning of the mount. To accomplish all-direction movement, the mounting arm may include a universal joint positioned substantially at each end of the mounting arm. The mounting plate may include an information handling device latching assembly for securing the information handling device to the mounting plate. The latching assembly may be further comprised of a locking assembly for securing the latching assembly in a desired position.

BRIEF DESCRIPTION OF THE DRAWINGS

The numerous objects and advantages of the present invention may be better understood by those skilled in the art by reference to the accompanying figures in which.

DESCRIPTION OF THE INVENTION

Reference will now be made in detail to presently preferred embodiments of the invention, examples of which are illustrated in the accompanying drawings.

Figure 1:
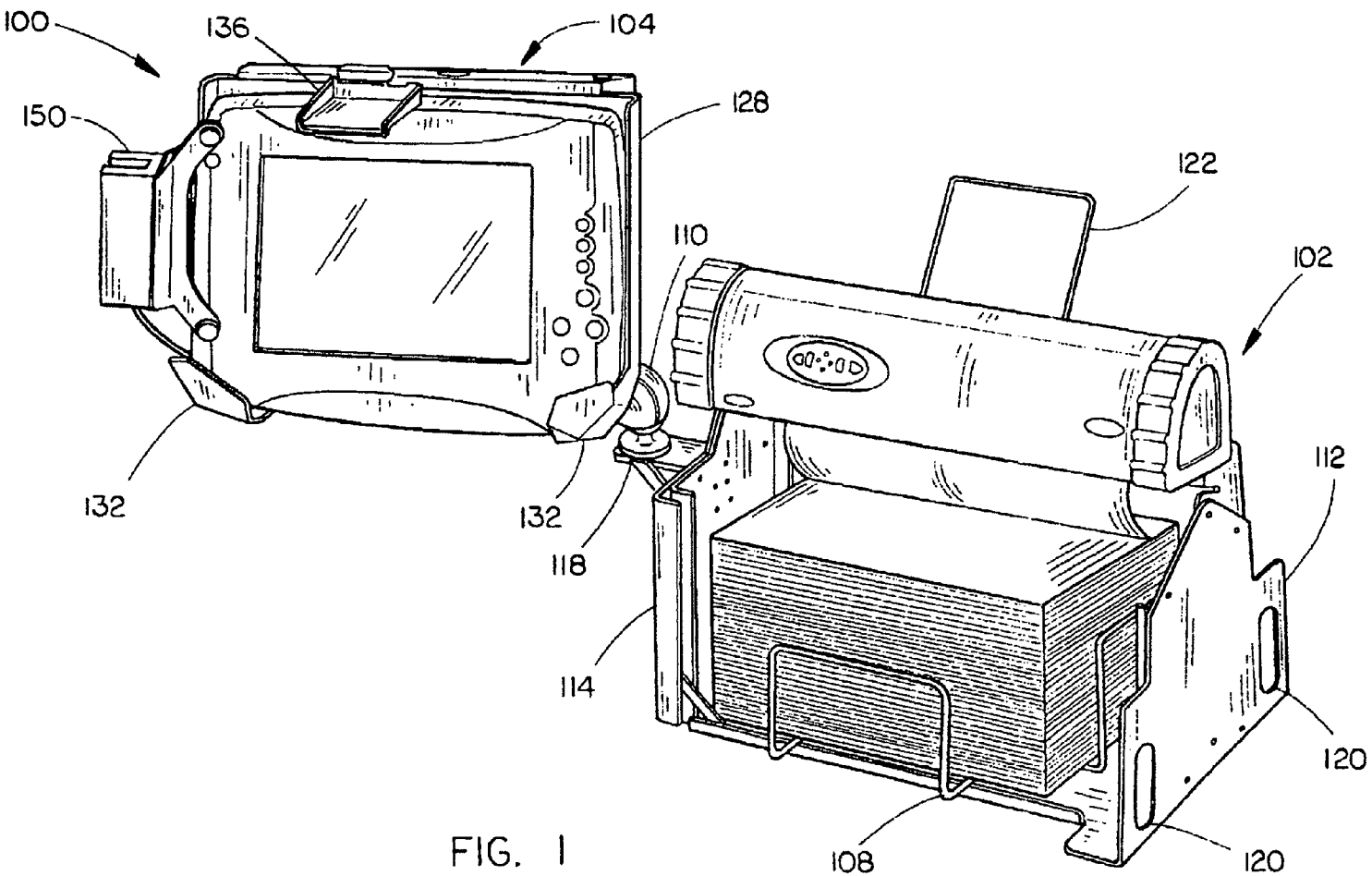
FIG. 1 is an isometric view of a system illustrating an information handling device and printing device positioned within a mounting apparatus in accordance with an exemplary embodiment of the present invention.
Figure 2:
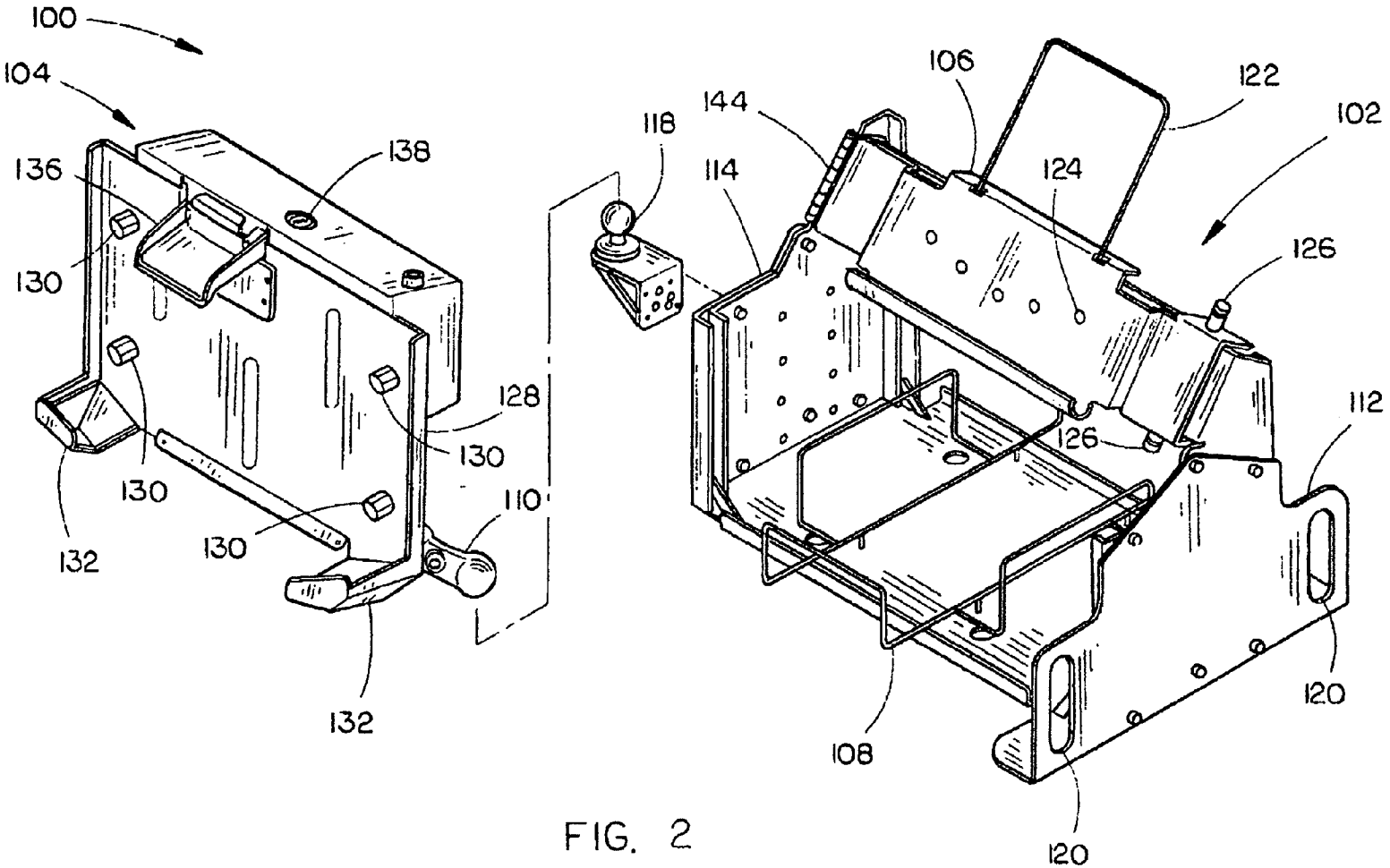
FIG. 2 is an isometric view illustrating the components of a mounting apparatus in accordance with an embodiment of the present invention, such as the embodiment shown in FIG. 1.

Referring to FIGS. 1 and 2, isometric views of a system illustrating an information handling device and printing device positioned within a mounting apparatus 100 and the individual components of the mounting apparatus in accordance with an exemplary embodiment of the present invention are shown. Mounting apparatus 100 may be substantially comprised of a frame assembly 102, a mount 104 for mounting a portable information handling device and a support 106 for supporting a printing device. Mounting apparatus 100 components may be substantially comprised of a combination of durable metals such as a metal alloy including steel, reinforced steel, galvanized steel or a like iron alloy suitable for resisting degradation, magnesium, polycarbonate or like polymeric material, or any material suitable for providing the requisite strength and lightweight properties that may be desired by a user. Referring specifically to FIG. 1, it is further contemplated that an apparatus in accordance with the present invention may be implemented in a mobile information handling system. While FIG. 1 shows a mounting apparatus 100 implemented with a tablet PC, it should be noted that any mobile information handling device may be mounted on mounting apparatus, including a cellular telephone, a personal digital assistant (PDA), a conventional laptop computer and like information handling devices. Implementing any of these devices with a mounting apparatus of the present invention may be accomplished with alternatively sized mounts custom fit to receive a specific device, or a universal mount adjustable to receiving the contemplated devices. Additionally, the system may be flexible to adjust a plurality of angles and positions within a transportation vehicle. Advantageously, the plurality of repositioning options may provide increased user efficiency, making it easier for a driver to operate a mobile information handling device, view the printed output of the printing device, tear off invoices and like functions.

Figure 3:
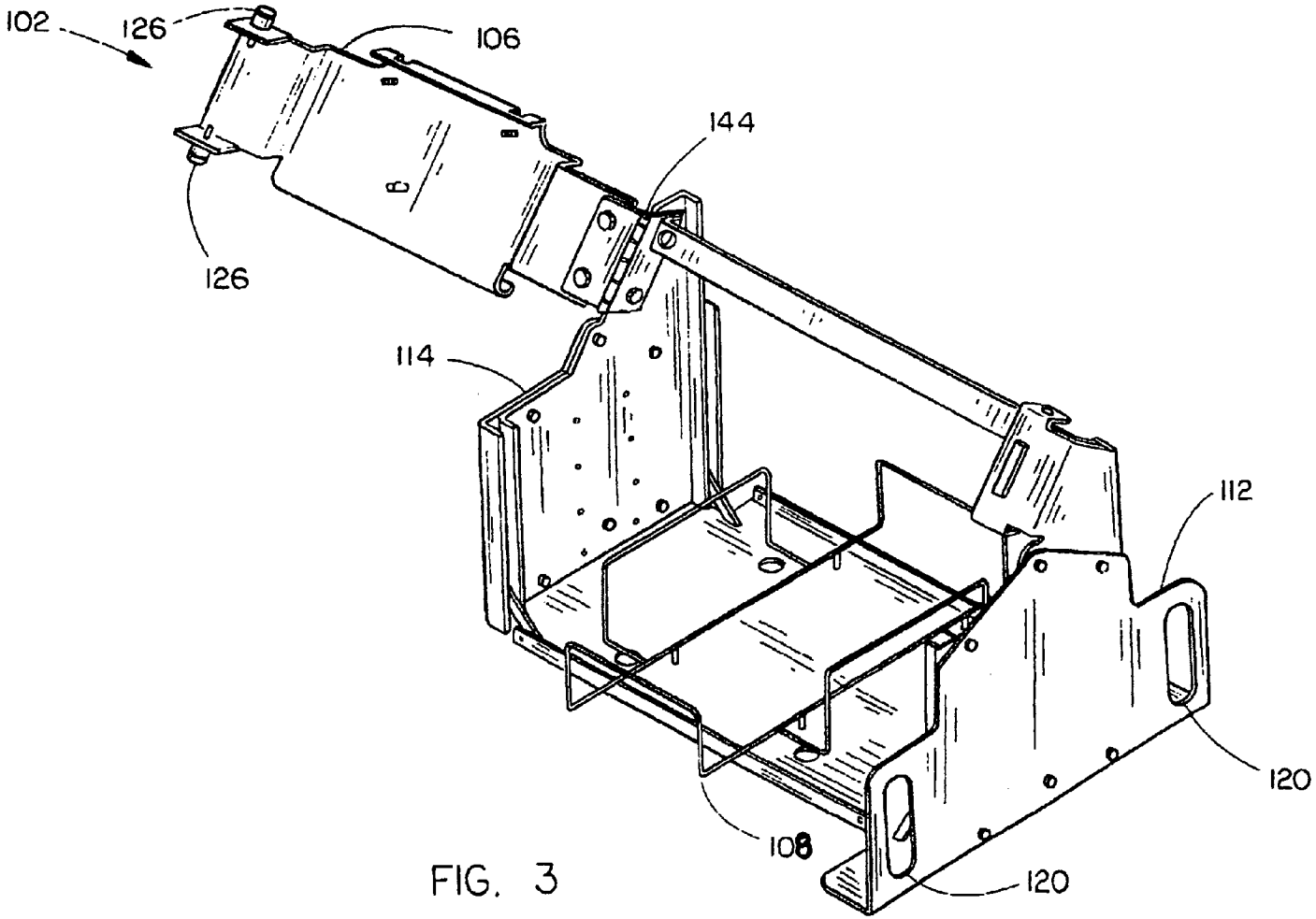
FIG. 3 is an isometric view of a support frame assembly of a mounting apparatus in accordance with an embodiment of the present invention.
Figure 4:
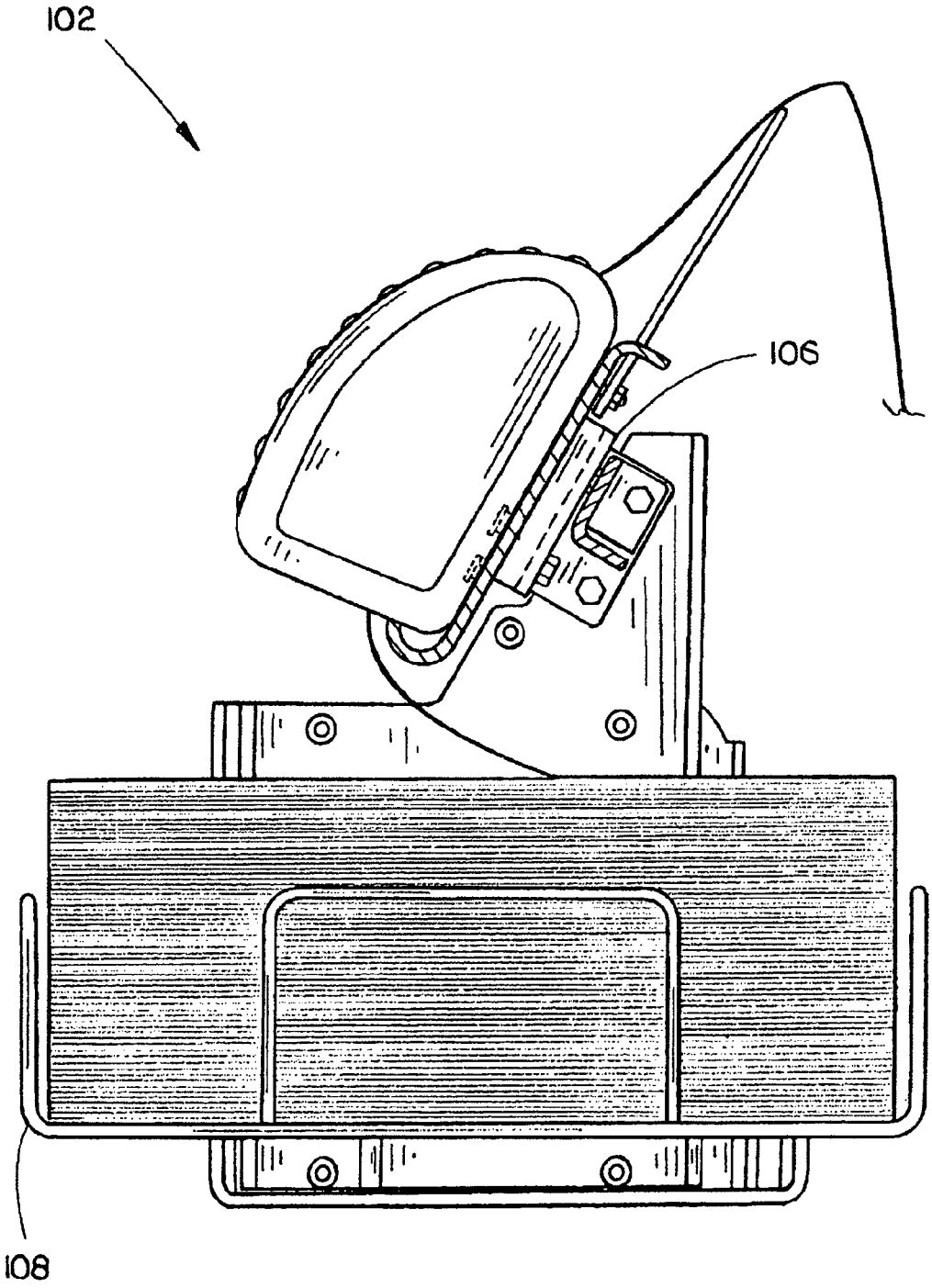
FIG. 4 is a side plan view illustrating a printing device positioned within a support frame assembly of a mounting apparatus in accordance with an embodiment of the present invention.

Referring to FIG. 3, an isometric view of a support frame assembly 102 of a mounting apparatus 100 in accordance with an embodiment of the present invention is shown. Mounting apparatus frame assembly 102 may be substantially comprised of a base support plate, and two or more vertical support plates. Frame assembly 102 may be further comprised of a printable media supply housing such as a basket assembly 108. Basket assembly 108 may be generally comprised of two or more wire frame components that may be bent to form right angles and coupled together at the centers of the wire frame components, substantially forming the shape of a square, rectangle, or a like shape suitable for receiving a supply of printable media such as a box of paper. Basket assembly shape may be adjustable by a user and may be customized for any desired shape. Customization may ensure a supply of printable media is secure within the basket assembly to reduce shifting. Additionally, basket assembly 108 may include one or more wire frame components suitable for fitting across the top of a supply of printable media. Top wire frame components may provide additional securing means for a supply of printable media for securing the media during transportation, particularly during situations when a vehicle encounters uneven terrain, a speed bump or like deviations from relatively smooth motion.

Support frame assembly 102 may be further comprised of two or more side bracket supports 112, 114 for providing elevation and support of printing device support. Side bracket supports 112, 114 may be implemented with stiffening bends for stabilization. Side bracket supports 112, 114 may be comprised of a plurality of apertures, each suitable for receiving a fastener such as a threaded nut. One or more threaded nuts may be substantially imbedded in a side bracket support 112, 114. Imbedded threaded nuts may be suitable for receiving a mating fastener such as a screw or bolt, and may provide a plurality of coupling options for a mounting arm universal ball joint 118. It is contemplated that a universal ball joint 118 may be coupled to a side bracket support 114. Universal ball joint may also be coupled with a mounting arm 110 for coupling the support frame assembly 102 to the mount 104.

To provide further stabilization of a mounting apparatus 100, support frame assembly 102 may include at least one slot 120 for receiving a seatbelt of a seat within a vehicle for securing the mounting apparatus to the seat. Additionally, a layer of shock insulating material such as foam or other such cushioning material may be coupled to the underside of the support frame assembly, between the support and printing device, or between the mounting and mobile information handling device to reduce vibration and movement. It is further contemplated that the front of the printing device support may be secured with bungie cord, nylon straps, or one or more hand formable metal outrigger rods.

Mounting apparatus support frame assembly 102 may be height adjustable. Specifically, the height of the support positioned over the supply of printable media is adjustable between at least a lower height for accommodating a supply of printable media having a first number of pages of printable media and a higher height for accommodating a supply of printable media having a second number of pages of printable media Height adjustment may be desirable for providing additional volume below the support. Additional volume may allow increased printable media supply to be inserted and housed in basket assembly. For example, mounting apparatus support frame assembly may provide multiple orientations, providing a variable volume of space between support and base support plate of mounting apparatus 100. One orientation may accommodate a 6" supply of printable media, another may accommodate a 12" supply of printable media, and the like.

Support may further include a printable media guide 122 suitable for providing a plurality of guided output orientations. Guided output orientations may prevent printed media exiting the printing device from falling back into the media supply box and potentially getting pulled back into printing device, causing a printing device jam. A straight output orientation may allow viewing of printout page closest to printing device. Bent version may allow printout page to fall back as it exits the printing device. This option may be utilized when view height is limited to prevent obstructed viewing of a passenger side mirror.

Figure 5:
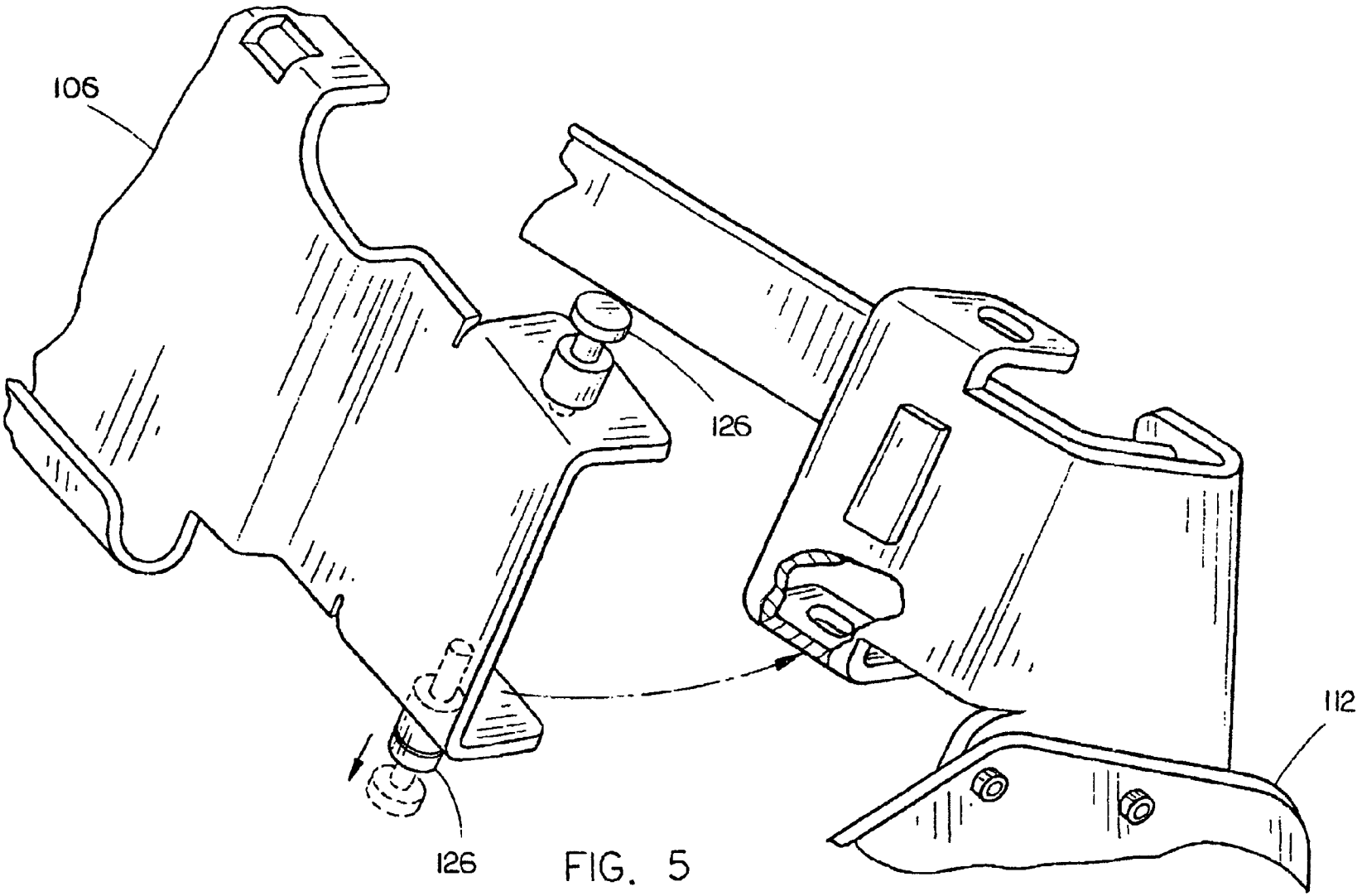
FIG. 5 is an exploded view illustrating a latching mechanism of a frame assembly of a mounting apparatus in accordance with an embodiment of the present invention.
Figure 6:
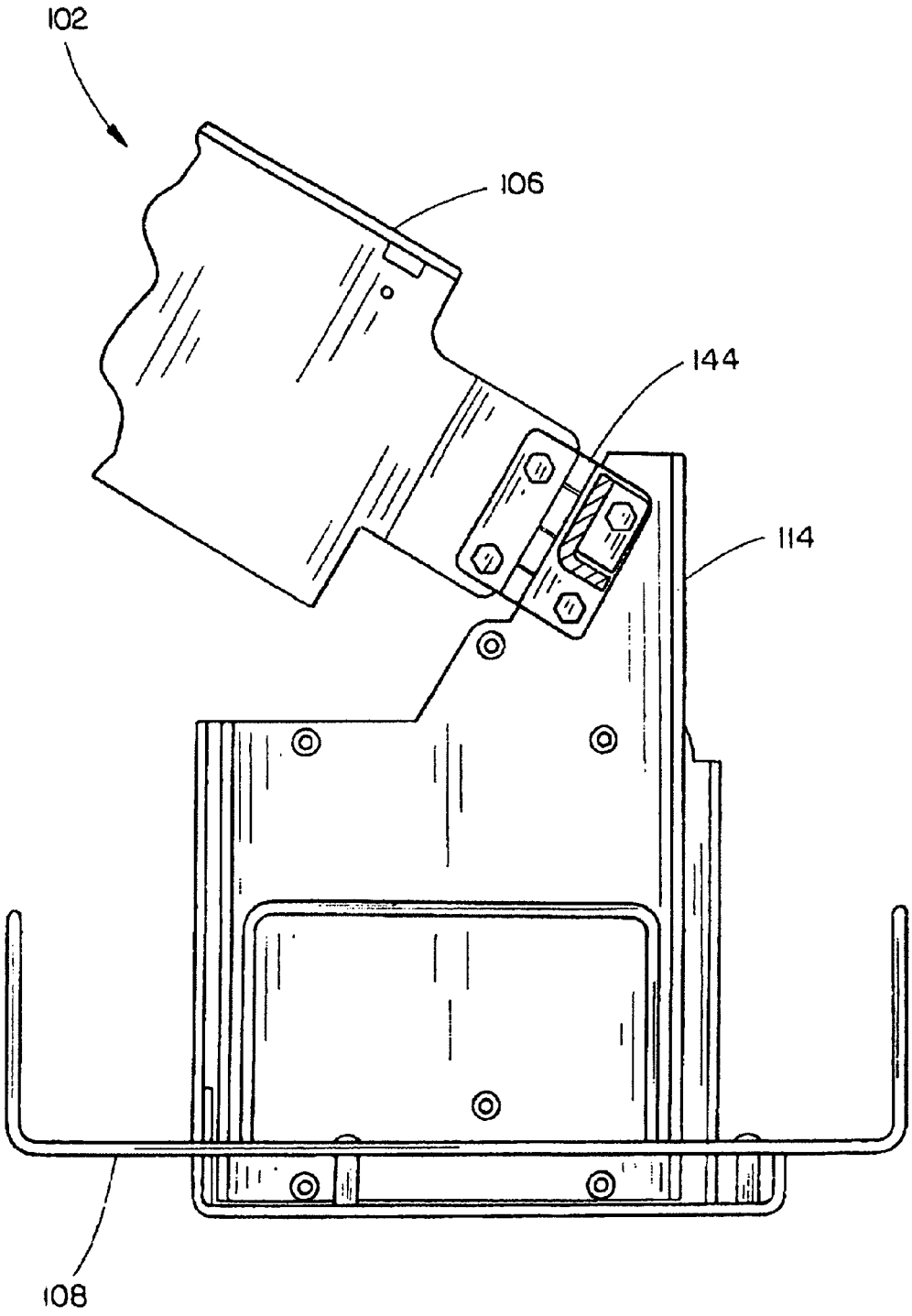
FIG. 6 is a side plan view of a support frame assembly of a mounting apparatus in accordance with an embodiment of the present invention.

A support 106 may be mounted to the support frame assembly for supporting a printing device. Support 10 may be substantially comprised of a front plate having at least one fastener 124 suitable for receiving a mating fastener coupled to a printing device for securing the printing device to the support. The support 106 may be pivotally coupled to the frame assembly 102 for allowing a printing device to be rotated between a first position and a second position. In one embodiment, the printing device may be positioned over the supply of printable media. However, it may be desirable to provide and a second position, for instance, positioning the printing device substantially away from the frame assembly 102 for allowing insertion of printable media into the basket assembly 108. One end of the support 106 may be rotatably coupled to the frame assembly 102. For example, support end may be coupled to a side support bracket 114 with a hinge mechanism 144. An opposite support end may be removably coupled to the frame assembly 102. Removable coupling may provide release of support end to allow access to an interior portion of the support frame assembly 102. In one embodiment, removable coupling of a support end to a frame assembly 102 may be accomplished via one or more plunge latch mechanisms 126. Referring to FIG. 5, an exploded view illustrating a plunge latch mechanism 126 of a frame assembly 102 of a mounting apparatus 100 in accordance with an embodiment of the present invention is shown. When a support 106 is positioned substantially over a supply of printable media, plunge latch mechanism 126 may be inserted through a receiving aperture located on the frame assembly 102. Plunge latch mechanism may spring loaded, and may be pulled in a direction substantially away from the support 106 such that the mechanism is no longer inserted through a receiving aperture. Support 106 may then be rotated outward to allow access to an interior portion of the frame assembly. It is further contemplated that one or more support ends may be removably coupled to the support frame assembly 102 utilizing any mechanism for partially or completely securing and unsecuring the support 106 to and from the frame assembly 102.

Figure 7:
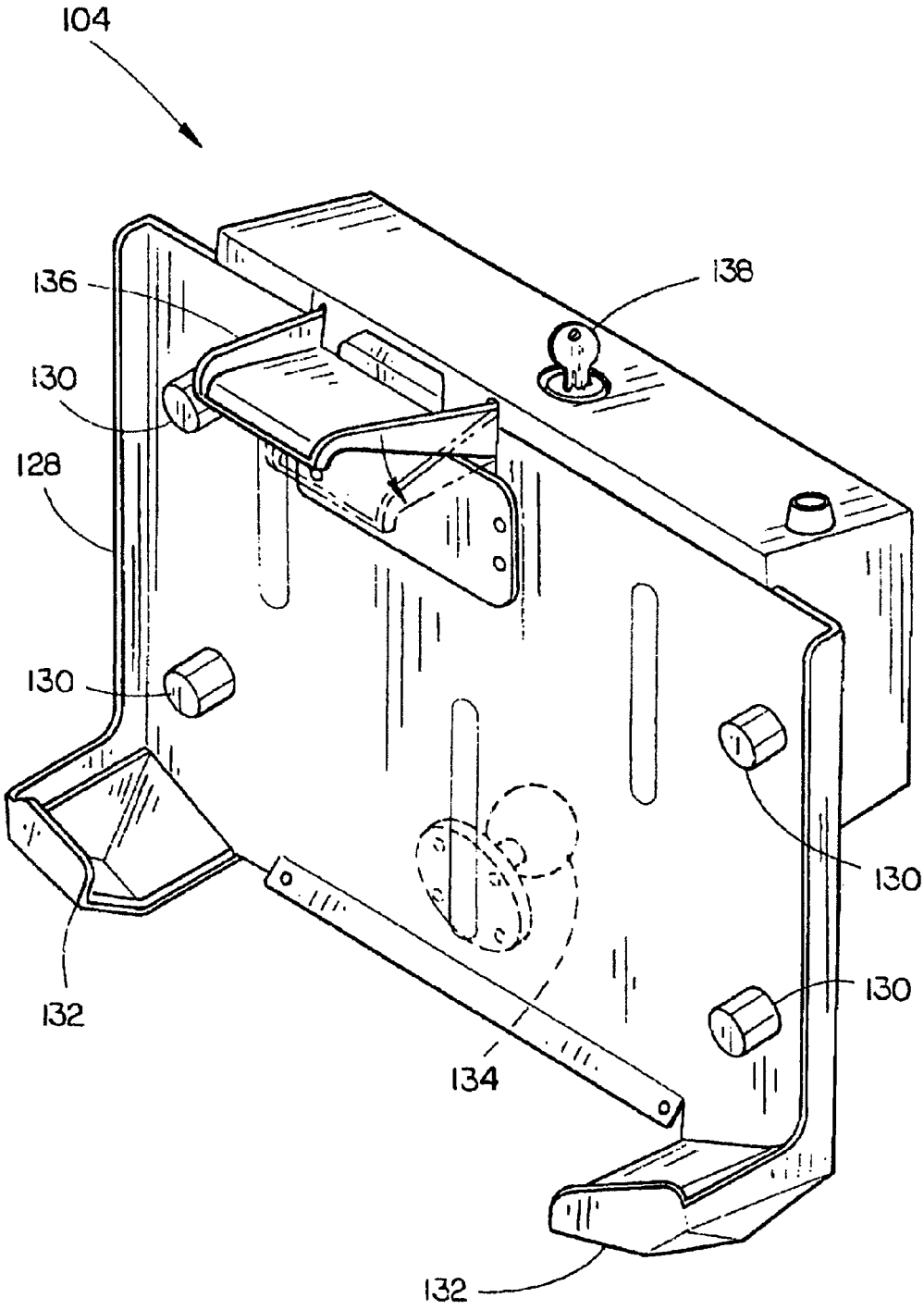
FIG. 7 is an isometric view of a mount of a mounting apparatus in accordance with an embodiment of the present invention.
Figure 8:
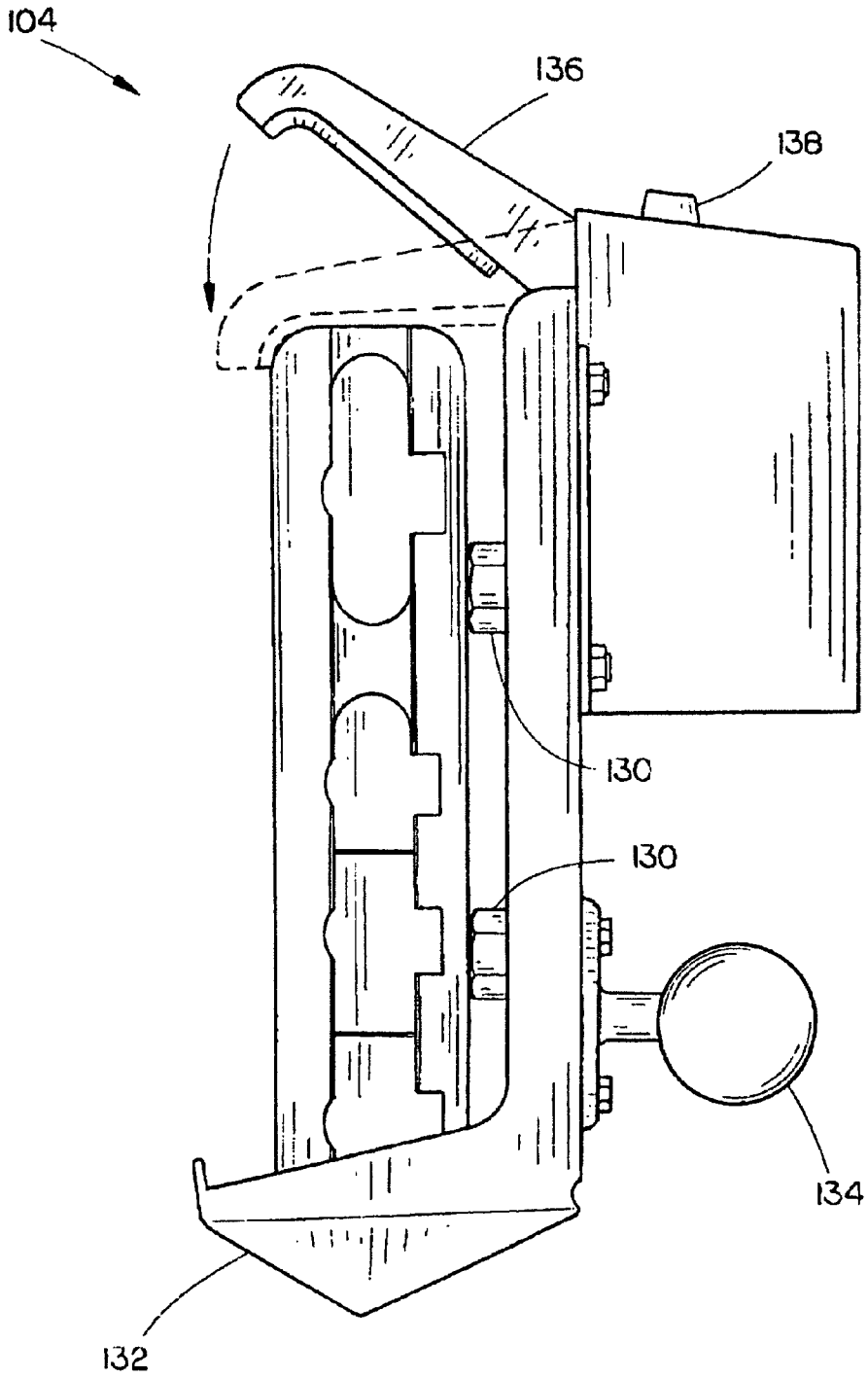
FIG. 8 is a side view of a mount of a mounting apparatus in accordance with an embodiment of the present invention.

Referring to FIGS. 7 and 8, isometric and side views of a mount 104 for mounting a mobile information handling device that may be implemented with a mounting apparatus 100 in accordance with an embodiment of the present invention are shown. Mounting apparatus mount 104 may be substantially comprised of a dock 128 for docking the mobile information handling device and a mounting arm 110 for coupling the dock 128 to the frame assembly 128. The mounting arm 110 may allow the dock 128 to be moved in three dimensions for positioning a mobile information handling device with respect to the frame assembly 102.

Dock 128 may be substantially comprised of plurality of raised elements 130 disposed on a front surface of the dock for supporting a mobile information handling device, at least one corner support plate 132 suitable for receiving a corner of an information handing device and universal ball joint 134 coupled to a rear surface of a dock 128. Mount may allow one-handed removal of information handling device. Mounting plate may include a channel insert for inserting an information handling device operating instrument such as a stylus. Incorporated operating instrument holder incorporated may allow easier access to an operating instrument while a mobile information handling device is mounted to the mount 104. Mount 104 may be further comprised of a latch assembly securing mechanism 136. Mount latch assembly 136 may be implemented with a lock and key assembly 138 for securing a latch in place or releasing the latch for removal or insertion of an information handling device. Latch assembly securing mechanism 136 may be adjustable, and may secure a mobile information handling device to the mount 104 whether or not the device is encased in a protective housing. It is contemplated that a mobile information handling device may include a carrying case for at least partially encasing the mobile information handling device. Mount 104 may accommodate a mobile information handling device encased in a protective housing such as a carrying case, sleeve, or other such encasing suitable for protecting the information handling device from elements such as weather, excessive handling and like causes of device wear and tear. To accomplish such adjustable accommodation of an information handling device, the latch assembly 136 may be adjustable for securing the mobile information handling device in the dock while placed in the carrying case or while not placed in the carrying case. Specifically, the latch assembly may be pivotably anchored to mount 104. Latch assembly 136 may pivot to a desired orientation, and may be secured at the orientation via the lock and key assembly 138.

Figure 9:
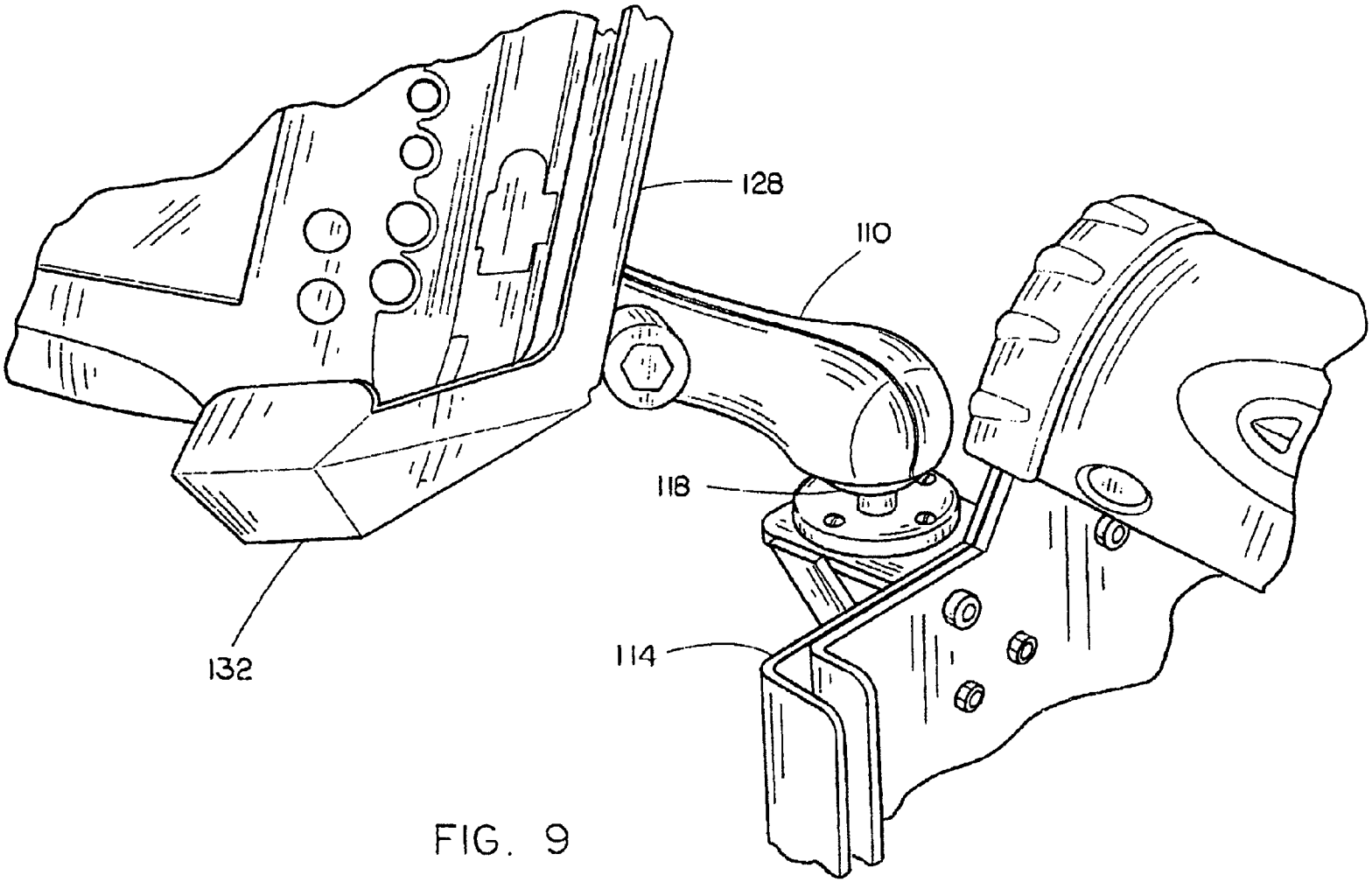
FIG. 9 is an exploded view of a mounting arm coupling a mount and a support frame assembly of a mounting apparatus in accordance with an embodiment of the present invention.

Mounting apparatus may be further comprised of a mounting arm 110 coupling the mount to the frame assembly. Referring to FIG. 9, an exploded view of a mounting arm 100 coupling a mount 104 and a support frame assembly 102 of a mounting apparatus 100 in accordance with an embodiment of the present invention is shown. The mounting arm 110 may be suited to receive at least one universal ball joint about which at least one of the mounting arm 100 and mount 104 may rotate during positioning of the mobile information handling device.

It is further contemplated that one or more mounting apparatus components may include a power adapter for providing electrical power to the mobile information handling device or printing device while the mobile information handling device or printing device is mounted to the mounting apparatus 100. For example, power adapter may be a DC power adapter docking connection for charging a mobile information handling device while docked in the dock. Mobile information handling device may be implemented with a PCB adapter having exposed surface contacts and spring finger contacts. It is further contemplated that mobile information handling system may be integrated with additional docking capabilities. For example, system may include a serial connection and wireless connectivity capabilities with Bluetooth or 802.11b technologies.

A mounting apparatus 100 in accordance with the present invention may include additional peripheral accessories for improving utility and function. For example, mounting apparatus 100 may include a mounting bracket and ball mount having multiple orientations and locations. In one embodiment, mounting bracket and ball mount system may include two locations, such as one location on a base side and one location on hinge side bracket. This may be an ideal positioning of these mounting apparatus components when the mounting apparatus is in an upper most orientation. Mounting apparatus may further include a shock mount adapter plate. Shock mount adapter plate may be utilized if a printing device mount requires mounting on an elevated platform such as a pedestal. Shock mount adapter place may absorb increased shock to the mounting apparatus 100 from the potentially less stable elevated environment.

Figure 10B:
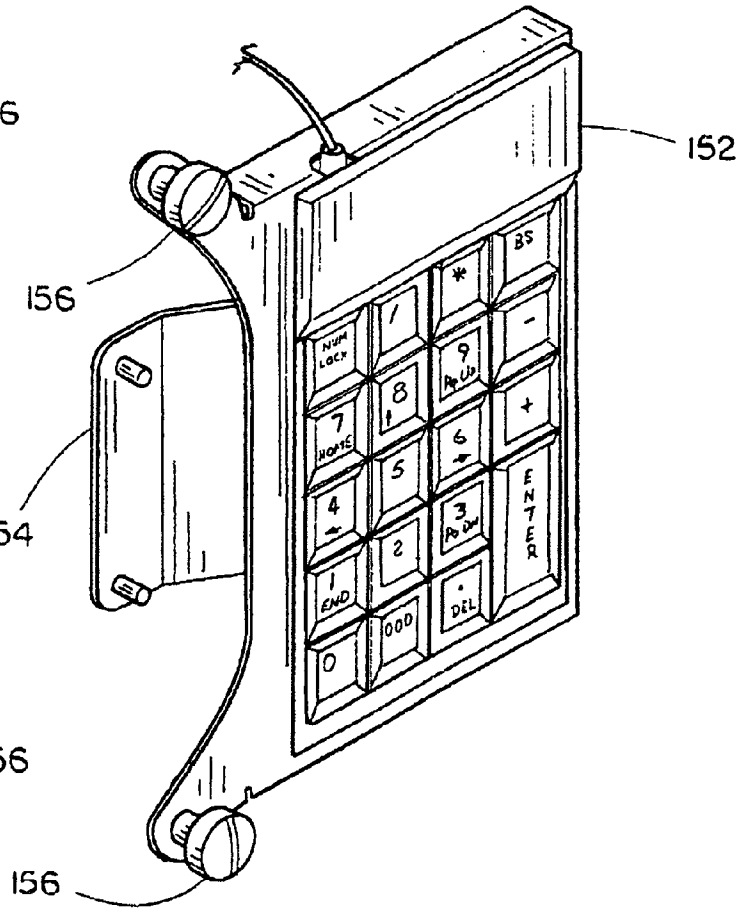
FIGS. 10A and 10B are isometric views of a magnetic card reader and a numeric keypad that may be mountable onto an information handling device positioned within a mounting apparatus in accordance with an embodiment of the present invention.
Figure 10A:
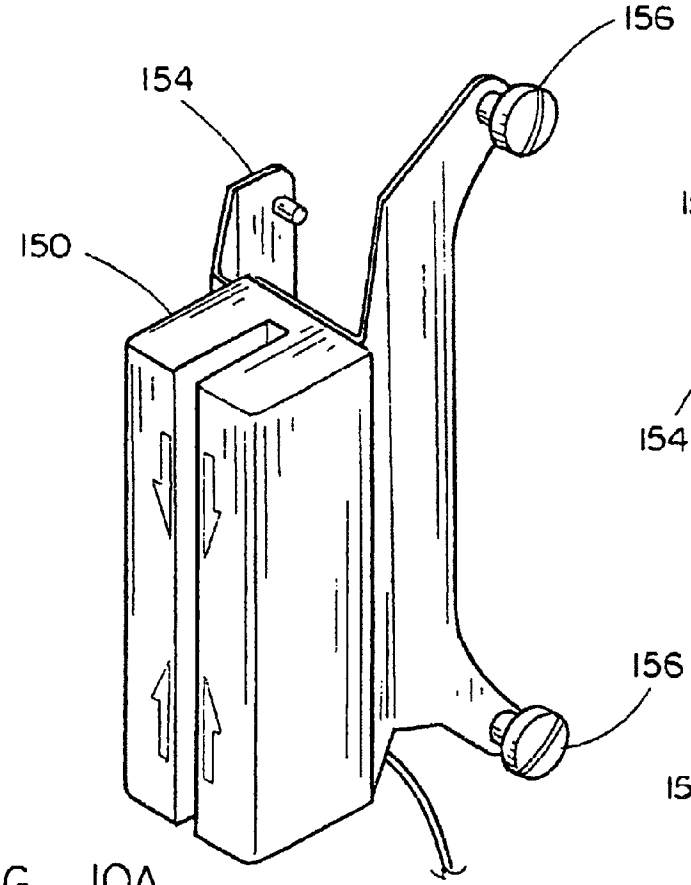
Figure 11:
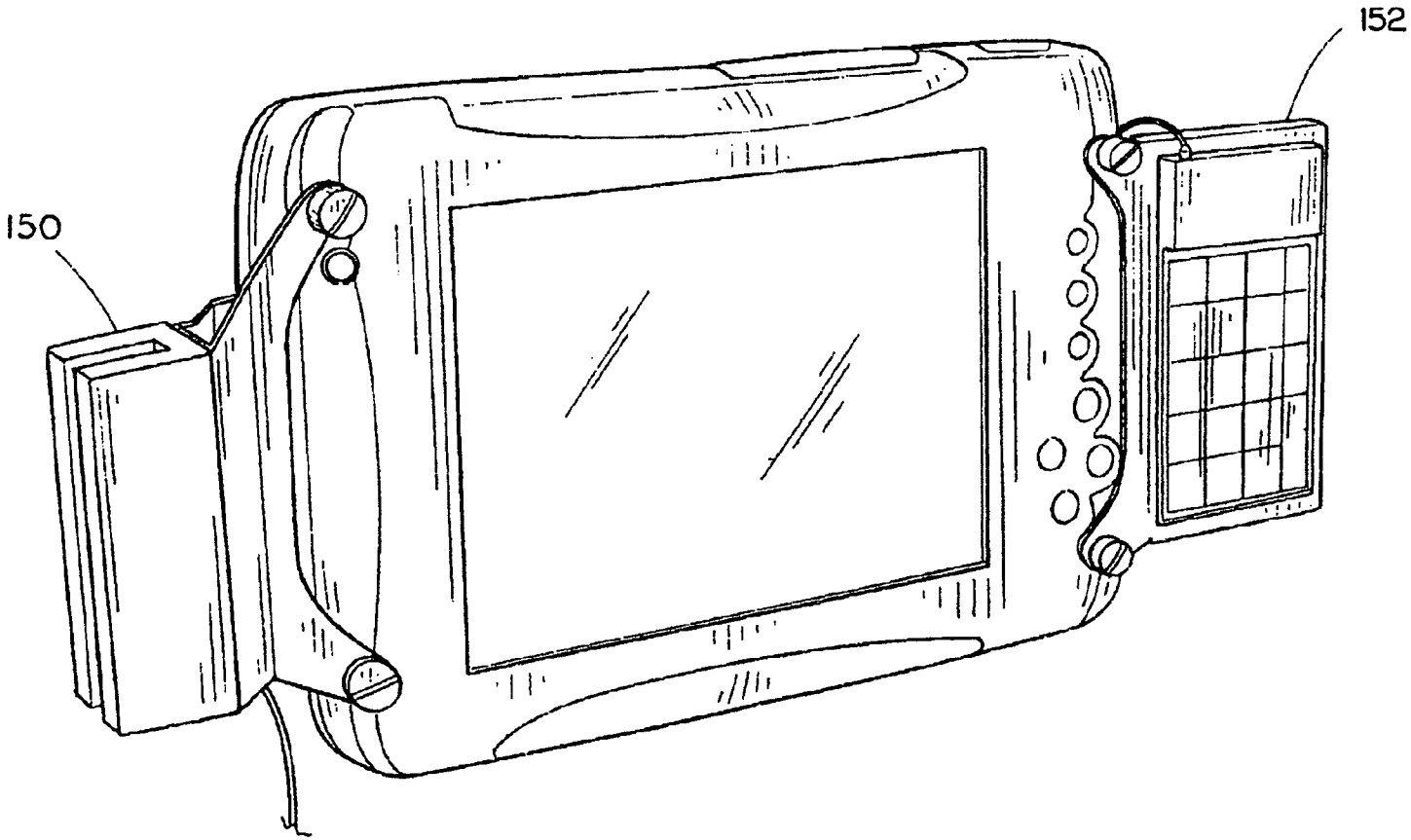
FIG. 11 is an isometric view of a magnetic card reader and numeric keypad mounted onto an information handling device in accordance with an embodiment of the present invention.
Figure 12:
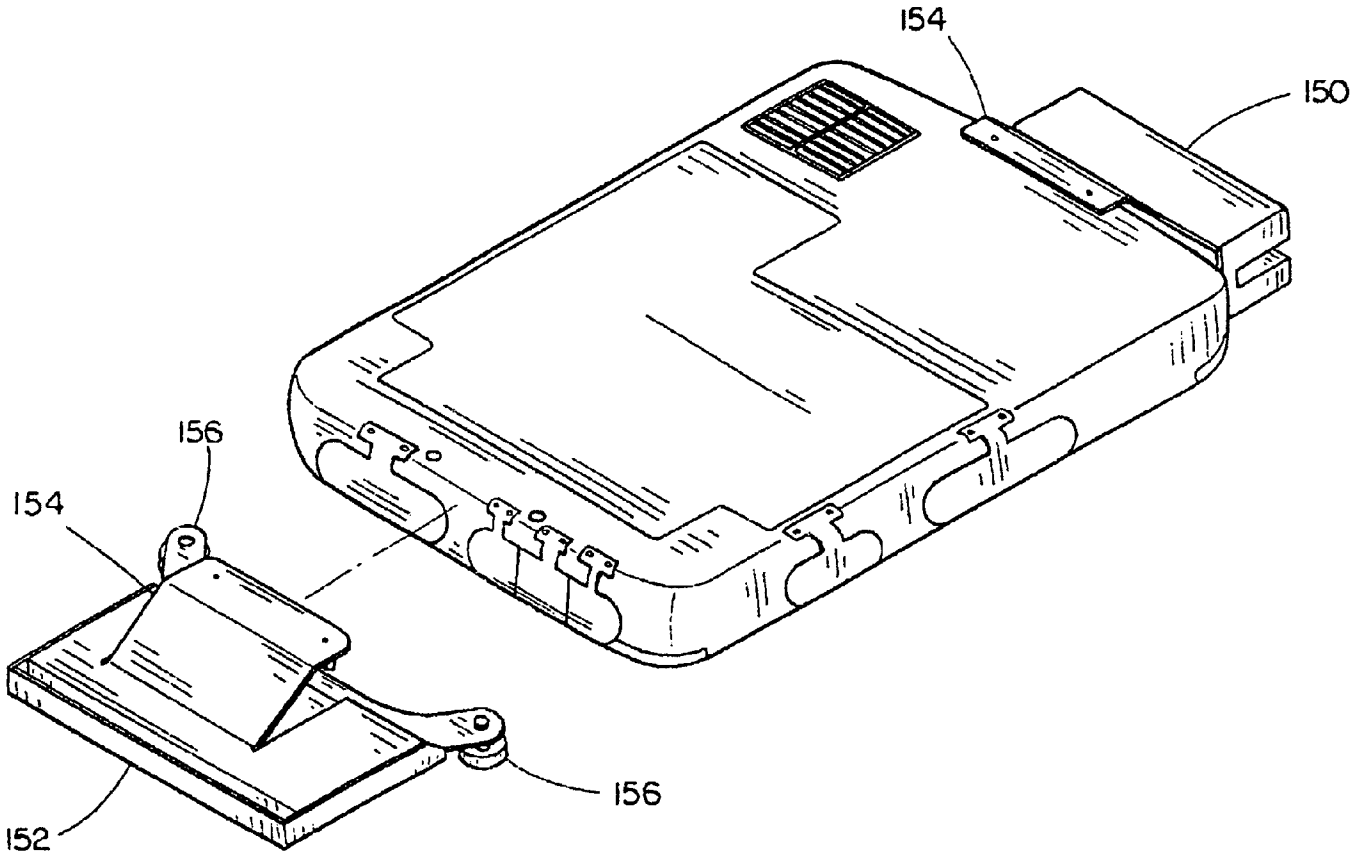
FIG. 12 is a back view of a magnetic card reader and numeric keypad mounted onto an information handling device in accordance with an embodiment of the present invention.

Referring to FIGS. 10A and 10B, 11 and 12, isometric views of a magnetic card reader 150 and a numeric keypad 152 that may be mountable onto an information handling device positioned within a mounting apparatus 100 in accordance with an embodiment of the present invention are shown. Mobile information handling system may include peripheral computing and communications accessories for increased utility of a mobile information handling device. Peripheral computing and communications accessories may be serially or wirelessly coupled to a mobile information handling device positioned within a mounting apparatus 100 of the present invention. Referring specifically to FIG. 10A, peripheral computing accessories may include a tray assembly substantially comprised of a magnetic card reader 150 coupled to a mounting tray. Referring specifically to FIG. 10B, peripheral computing accessories may include a tray assembly substantially comprised of a numeric keypad 152 coupled to a mounting tray.

Utility of a mobile information handling device may be improved by one or more metal bracket assemblies 154 suitable for enabling mounting of desired peripheral computing or communications accessories. Bracket assembly 154 may provide "no-tools" mounting of the card reader assembly 150 and numeric key pad tray assembly 152 to the carrying case encasing a mobile information handling device or directly to the mobile information handling device. Bracket assembly 154 may include at least one screw assembly configured to secure tray assembly 154 to a mobile information handling device without inserting the screw assembly into the device. The screw assembly may contact the surface of the device and provide adequate tension to prevent a tray assembly 154 from undesired self-removal from the mobile information handling device. Card reader assembly 150 and keypad assembly 152 may be stably mounted without the need for physical modifications to the mobile information handling device. Configuration of the installed card reader 150 and the installed keypad assembly 152 may also provide a storage area in conjunction with the outer end wall of the computer for excess data cord to be conveniently and securely stored. Position of the card reader assembly 150 with respect to the computer data interconnection allows convenient clearance for the operation of sliding a card through the card reader reading slot.

It is believed that the apparatus of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof.

What is claimed:

1. A mounting apparatus for mounting a mobile information handling device and a printing device, comprising a support frame assembly, the support frame assembly including at least one slot for receiving a seatbelt for securing the mounting apparatus;

a mount coupled to the support frame assembly for mounting the mobile information handling device, the mount including a dock for docking the mobile information handling device, the mount further including a latch assembly mechanism adjustable in at least a first position for securing the mobile information handling device to the dock and a second position for removing the mobile information handling device from the dock, the latch assembly mechanism further including a lock-and-key assembly for securing and releasing the latch assembly mechanism, the mount further including a mounting arm receiving a universal ball joint for coupling the dock to the support frame assembly so that the dock can be moved in three dimensions for positioning the mobile information handling device with respect to the support frame assembly, the dock further including a plurality of raised elements disposed on a front surface of the dock for supporting a back cover of the mobile information handling device, and at least two corner support plates including a front portion opposite the front surface of the dock, each for receiving a bottom corner of the mobile information handing device for supporting the mobile information handling device and for securing the mobile information handling device to the dock; and a support mounted to the support frame assembly for supporting the printing device; the support including:

a plate further including a first end including a pivotal coupler pivotally coupling the first end of the plate to the support frame assembly and a second end including a releasable coupler releasably coupling the second end of the plate to the support frame assembly substantially opposite the first end, the plate further including at least one fastener capable of receiving a mating fastener coupled to a printing device, the plate rotatable substantially away from the support frame assembly;

wherein the support frame assembly is configured for holding a supply of printable media and the support frame assembly positions the printing device in at least a first and a second position with respect to the supply of printable media for feeding printable media from the supply of printable media through the printing device.

2. The mounting apparatus as claimed in claim 1, wherein the support frame assembly comprises a basket assembly for holding the supply of printable media.

3. The mounting apparatus as claimed in claim 2, wherein the support is pivotally coupled to the support frame assembly to pivot between a first position wherein the support is positioned over the supply of printable media and a second position wherein the support is positioned for allowing insertion of printable media into the basket assembly.

4. The mounting apparatus as claimed in claim 1, wherein the pivotal coupler is a hinge.

5. The mounting apparatus as claimed in claim 1, wherein the releasable coupler is a plunge latch assembly.

6. The mounting apparatus as claimed in claim 5, wherein the support frame assembly includes:

at least one aperture for receiving the plunge latch assembly.

7. The mounting apparatus as claimed in claim 1, wherein the support further includes:

a printable media guide suitable for providing a plurality of guided output orientations.

8. A mounting apparatus for mounting a mobile information handling device and a printing device, comprising a support frame assembly, the support frame assembly including at least one slot for receiving a seatbelt for securing the mounting apparatus;

means, coupled to the support frame assembly, for mounting the mobile information handling device further including a dock for docking the mobile information handling device, the means for mounting the mobile information handling device further including a latch assembly mechanism adjustable in at least a first position for securing the mobile information handling device to the dock and a second position for removing the mobile information handling device from the dock, the latch assembly mechanism further including a lock-and-key assembly for securing and releasing the latch assembly mechanism, the means for mounting the mobile information handling device further including a mounting arm receiving a universal ball joint for coupling the dock to the support frame assembly so that the dock can be moved in three dimensions for positioning the mobile information handling device with respect to the support frame assembly, the dock further including a plurality of raised elements disposed on a front surface of the dock for supporting a back cover of the mobile information handling device, and at least two corner support plates including a front portion opposite the front surface of the dock, each for receiving a bottom corner of the mobile information handing device for supporting the mobile information handling device and for securing the mobile information handling device to the dock; and means, mounted to the support frame assembly, for supporting the printing device further including a first end including a pivotal coupler pivotally coupling the first end of the printing device support means to the support frame assembly and a second end including a releasable coupler releasably coupling the second end of the printing device support means to the support frame assembly substantially opposite the first end, the printing device support means further including at least one fastener capable of receiving a mating fastener coupled to a printing device, the printing device support means rotatable substantially away from the support frame assembly;

wherein the support frame assembly is configured for holding a supply of printable media and the printing device supporting means positions the printing device in at least a first and second position with respect to the supply of printable media for feeding printable media from the supply of printable media through the printing device.

9. The mounting apparatus as claimed in claim 8, wherein the mobile information handling device mounting means allows the mobile information handling device to be moved in three dimensions for positioning the mobile information handling device with respect to the support frame assembly and the printing device support means rotate between a first position wherein the printing device support means is positioned over the supply of printable media and a second position wherein the printing device support means is positioned substantially away from the support frame assembly means for inserting the supply of printable media into the support frame assembly means.

* * * * *